US009676076B2

(12) United States Patent
Namiki et al.

(10) Patent No.: US 9,676,076 B2
(45) Date of Patent: Jun. 13, 2017

(54) POLISHING METHOD AND POLISHING APPARATUS

(71) Applicant: EBARA CORPORATION, Tokyo (JP)

(72) Inventors: Keisuke Namiki, Tokyo (JP); Hozumi Yasuda, Tokyo (JP); Shingo Togashi, Tokyo (JP)

(73) Assignee: Ebara Corporation, Tokyo (JP)

( * ) Notice: Subject to any disclaimer, the term of this patent is extended or adjusted under 35 U.S.C. 154(b) by 308 days.

(21) Appl. No.: 13/916,432

(22) Filed: Jun. 12, 2013

(65) Prior Publication Data

US 2013/0337722 A1 Dec. 19, 2013

(30) Foreign Application Priority Data

Jun. 13, 2012 (JP) ..... 2012-133813
May 28, 2013 (JP) ..... 2013-112087

(51) Int. Cl.
*B24B 37/013* (2012.01)

(52) U.S. Cl.
CPC ..... *B24B 37/013* (2013.01)

(58) Field of Classification Search
CPC ..... B24B 37/013
See application file for complete search history.

(56) References Cited

U.S. PATENT DOCUMENTS 5,609,718 A 3/1997 Meikle
5,655,951 A 8/1997 Meikle et al.
5,801,066 A 9/1998 Meikle
6,876,454 B1 * 4/2005 Birang et al. ..... 356/503
7,160,739 B2 1/2007 Shanmugasundram et al.
8,025,759 B2 9/2011 Sasaki et al.
2003/0027424 A1 * 2/2003 Paik ..... 438/692
2006/0166503 A1 * 7/2006 Sasaki et al. ..... 438/692
2006/0196283 A1 * 9/2006 Yang et al. ..... 73/865.9
2009/0137190 A1 5/2009 Togawa et al.
2013/0065493 A1 * 3/2013 Takahashi ..... 451/59

FOREIGN PATENT DOCUMENTS

JP 2004-25413 1/2004
JP 2004-47876 2/2004
JP 2005-342841 12/2005
JP 2005-347568 12/2005
JP 2007-324458 A 12/2007
(Continued)

*Primary Examiner* — Larry E Waggle, Jr.
*Assistant Examiner* — Henry Hong
(74) *Attorney, Agent, or Firm* — Baker & Hostetler LLP

(57) ABSTRACT

A polishing method is used for polishing a film formed on a substrate by pressing the substrate against a polishing pad. The polishing method includes preparing, in advance, an algorithm for correction of polishing time from a relationship between a known amount of wear of the polishing pad or a known thickness of the polishing pad, and a polishing time and a polishing amount; setting a polishing target value for the film; and measuring an amount of wear of the polishing pad or a thickness of the polishing pad. The polishing method further includes determining an optimal polishing time for the polishing target value from the measured amount of wear of the polishing pad or the measured thickness of the polishing pad and from the algorithm; and polishing the film for the determined optimal polishing time.

8 Claims, 12 Drawing Sheets

(56) References Cited

FOREIGN PATENT DOCUMENTS

| | | | |
|---|---|---|---|
| JP | 2008-258510 | A | 10/2008 |
| JP | 2009-136926 | A | 6/2009 |
| JP | 2010-027701 | A | 2/2010 |
| JP | 2010-087135 | A | 4/2010 |
| WO | WO 2006/049269 | | 5/2006 |

* cited by examiner

POLISHING METHOD AND POLISHING APPARATUS

CROSS REFERENCE TO RELATED APPLICATIONS

This document claims priorities to Japanese Patent Application Number 2012-133813, filed Jun. 13, 2012 and Japanese Patent Application Number 2013-112087, filed May 28, 2013, the entire contents of which are hereby incorporated by reference.

BACKGROUND OF THE INVENTION

Field of the Invention

The present invention relates to a polishing method and apparatus for polishing a film formed on a substrate such as a semiconductor wafer by pressing the substrate against a polishing pad while moving the substrate and the polishing pad relative to each other.

Description of the Related Art

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). Thus, there has been employed a chemical mechanical polishing apparatus for planarizing a surface of a semiconductor wafer. In the chemical mechanical polishing apparatus, while a polishing liquid containing abrasive particles such as silica ($SiO_2$) therein is supplied onto a polishing surface of a polishing pad, a substrate such as a semiconductor wafer is brought into sliding contact with the polishing surface, so that a film formed on the substrate is polished.

This type of polishing apparatus includes a polishing table having a polishing pad, and a top ring for holding a substrate such as a semiconductor wafer. The polishing apparatus generally has a retainer ring at an outer circumferential side of the substrate for pressing the polishing pad. When the film formed on the substrate is polished using such a polishing apparatus, the substrate is held and pressed against the polishing pad under a predetermined pressure by the top ring. At this time, while a polishing liquid is supplied onto the polishing pad, the polishing pad and the top ring are moved relative to each other to bring the film on the substrate into sliding contact with the polishing pad in the presence of the polishing liquid, so that the film on the substrate is polished to a flat mirror finish.

It has been known that in the polishing process using a polishing pad comprising IC-1000/SUBA400 (two-layer cloth), for example, polishing performance (polishing rate or polishing profile) is liable to be varied due to a change in properties of the polishing pad such as wear of the upper layer (IC-1000) of the polishing pad.

FIG. 1 is a graph showing an example of the relationship between a thickness of a polishing pad (IC-1000) and a polishing rate in a polishing process. As shown in FIG. 1, as the thickness of the polishing pad is thinner, the polishing rate increases. FIG. 2 is a graph showing an example of non-dimensional polishing rate with respect to radial positions on a substrate when the film on the substrate is polished by using polishing pads (IC-1000) having different thicknesses, 32 mils, 50 mils and 80 mils. As shown in FIG. 2, the polishing profile differs with the thickness of the polishing pad.

Therefore, in order to maintain a constant polishing amount and a constant polishing profile for a film, it is necessary to appropriately change polishing conditions, such as a polishing time and a polishing pressure, according to a decrease in the thickness of the polishing pad, for example, when the thickness of the polishing pad has decreased (worn) by dressing of the polishing pad by means of a dresser.

Conventionally, as a method for cancelling variation in the polishing performance caused by such a conditional change of the polishing pad, closed-loop control (CLC) using an ITM (in-line thickness monitor) or an R-ECM (eddy current monitor) is commonly used.

However, in the case of the CLC using an ITM, it is necessary to take a substrate such as a semiconductor wafer out of a polishing section, and clean and dry the substrate every time the surface condition of the substrate is measured. Therefore, a series of operations for such measurement requires a lot of time, resulting in a decreased throughput. Further, the CLC method using an R-ECM can be applied only when a film to be polished is a metal film. For example, in a polishing process of a copper film formed on a substrate, the second-step polishing (touch-up) after the removal of the copper film from the substrate surface has been practiced in a "blind" polishing manner under fixed polishing conditions and a fixed polishing time. Thus, variation in the polishing performance caused by a conditional change of the polishing pad has an effect on the polishing result of the substrate, leading to a lowering of the productivity. Also in the polishing process of a metal film to which the CLC method using an R-ECM can be applied, the introduction of a system to perform such control method requires a great deal of expenses.

The applicant of the present invention has proposed a polishing apparatus in which the amount of wear of a wearing member such as a polishing pad is calculated to determine whether a polishing process is being performed in a normal manner, or correlation data showing a correlation between the amount of wear of a wearing member such as a polishing pad and a polishing profile are accumulated to appropriately control polishing conditions (see Japanese Laid-Open Patent Publication No. 2006-255851), and a polishing apparatus in which polishing conditions are changed according to a change in the profile of a polishing pad (see Japanese Laid-Open Patent Publication No. 2009-148877).

The applicant of the present invention has also proposed a substrate polishing method and apparatus in which the relationship between the thickness of a polishing pad and the polishing rate during the period immediately after replacement of a polishing pad until subsequent replacement of a polishing pad is determined in advance, and the polishing time for the next substrate is optimized based on the thickness of the polishing pad actually measured (see Japanese Laid-Open Patent Publication No. 2005-347568).

There has been proposed a method for planarizing a surface of a semiconductor wafer which includes a step of measuring the rate of removal of a wafer material from a wafer, and a step of providing a model that clarifies the effects on polishing effectiveness caused by the conditions of a tool, such as the wear of the tool, variation of the tool with time from the use of the tool, and the like (see U.S. Pat. No. 7,160,739 B2).

Further, there have been proposed a method for determining the life of a polishing pad in which the thickness of a polishing pad is measured, and when the measured thickness reaches a predetermined value or less, the polishing pad is judged to reach the end of its life (see Japanese Laid-Open Patent Publication No. 2004-25413), and a polishing apparatus in which the profile of a polishing pad is controlled by changing dressing conditions for the polishing pad (see Japanese Laid-Open Patent Publication No. 2004-47876).

Furthermore, there have been proposed a polishing apparatus in which dressing conditions are changed to obtain a desired polishing rate when a change in the cut rate by dressing of the polishing pad has occurred (see U.S. Pat. Nos. 5,609,718, 5,801,066, and 5,655,951), and a polishing apparatus in which an estimated polishing rate is calculated by substituting a measurement value of the remaining thickness of the polishing pad into a model equation prepared by multiple regression analysis of the thickness of a polishing pad and the actual polishing rate, and a process abnormality is judged by determining whether or not the estimated polishing rate falls within a predetermined range (see Japanese Laid-Open Patent Publication No. 2005-342841).

SUMMARY OF THE INVENTION

None of the above patent documents disclose a technique to perform feedforward control, especially capable of dealing with the second-step polishing (touch-up) after the removal of a copper film from a substrate surface, by appropriately changing the polishing time for polishing a film, without measuring the thickness of the film, according to an amount of wear (decrease in the thickness) of a polishing pad when the thickness of the polishing pad has decreased (worn), for example, by dressing of the polishing pad.

The present invention has been made in view of the above circumstances. It is therefore an object of the present invention to provide a polishing method and a polishing apparatus which can be introduced at a lower cost as compared to the CLC method using an ITM or R-ECM and can deal with the second-step polishing (touch-up) after the removal of a copper film from a substrate surface without measuring the thickness of the film, and which can polish the film with stable polishing performance throughout the life of a polishing pad without involving a decrease in the throughput unlike the CLC method using an ITM.

In order to achieve the object, according to a first aspect of the present invention, there is provided a polishing method for polishing a film formed on a substrate by pressing the substrate against a polishing pad on a polishing table, comprising: preparing, in advance, an algorithm for correction of polishing time from a relationship between a known amount of wear of a polishing pad or a known thickness of the polishing pad, and a polishing time required to polish a predetermined polishing amount of the substrate by the polishing pad having the known amount of wear of the polishing pad or the known thickness of the polishing pad, and the predetermined polishing amount, or a relationship between a known amount of wear of a polishing pad or a known thickness of the polishing pad, and a polishing amount obtained when the substrate is polished by a predetermined polishing time by the polishing pad having the known amount of wear of the polishing pad or the known thickness of the polishing pad, and the predetermined polishing time; setting a polishing target value for a film; measuring an amount of wear of a polishing pad or a thickness of the polishing pad used for polishing; determining an optimal polishing time for the polishing target value from the measured amount of wear of the polishing pad or the measured thickness of the polishing pad and from the algorithm; and polishing the film for the determined optimal polishing time.

Here, a predetermined polishing amount refers to a polishing amount serving as the criteria used when the polishing time correction formula is determined. A polishing time refers to a time required to polish the polishing amount as the criteria.

According to a second aspect of the present invention, there is provided a polishing method for polishing a film formed on a substrate by pressing the substrate against a polishing pad on a polishing table, comprising: preparing, in advance, an algorithm for correction of polishing time from a relationship between the number of substrates that have been polished on a polishing pad or an accumulated dressing time for the polishing pad, and a polishing time required to polish a predetermined polishing amount of the substrate by the polishing pad which has processed the known number of substrates or by the polishing pad which has been dressed by the known accumulated dressing time, and the predetermined polishing amount, or a relationship between the number of substrates that have been polished on a polishing pad or the accumulated dressing time for the polishing pad, and a polishing amount obtained when the substrate is polished by a predetermined polishing time by the polishing pad which has processed the known number of substrates or by the polishing pad which has been dressed by the known accumulated dressing time, and the predetermined polishing time; setting a polishing target value for a film; measuring the number of substrates that have been polished on a polishing pad or the accumulated dressing time for the polishing pad; determining an optimal polishing time for the polishing target value from the measured number of substrates that have been polished on the polishing pad or the measured accumulated dressing time for the polishing pad and from the algorithm; and polishing the film for the determined optimal polishing time.

According to a third aspect of the present invention, there is provided a polishing apparatus for polishing a film formed on a substrate by pressing the substrate against a polishing pad on a polishing table, comprising: a polishing pad measuring device configured to measure an amount of wear of the polishing pad or a thickness of the polishing pad used for polishing; a memory unit configured to store the amount of wear of the polishing pad or the thickness of the polishing pad, measured by the polishing pad measuring device; a storage unit configured to store an algorithm for correction of polishing time, the algorithm being prepared from a relationship between a known amount of wear of a polishing pad or a known thickness of the polishing pad, and a polishing time required to polish a predetermined polishing amount of the substrate by the polishing pad having the known amount of wear of the polishing pad or the known thickness of the polishing pad, and the predetermined polishing amount, or a relationship between a known amount of wear of a polishing pad or a known thickness of the polishing pad, and a polishing amount obtained when the substrate is polished by a predetermined polishing time by the polishing pad having the known amount of wear of the polishing pad or the known thickness of the polishing pad, and the predetermined polishing time; and a calculation unit configured to calculate an optimal polishing time for a polishing target value from an amount of wear of a polishing pad or a thickness of the polishing pad measured by the polishing pad measuring device, and from the algorithm for correction of polishing time.

The polishing method and the polishing apparatus of the present invention can perform feedforward control, especially capable of dealing with the second-step polishing (touch-up) after the removal of a copper film from a substrate surface, by appropriately changing the polishing time for polishing a film, without measuring the thickness of the film, according to an amount of wear (decrease in the thickness) of a polishing pad when the thickness of the polishing pad has decreased (worn), for example, by dressing of the polishing pad. Further, the polishing method and the polishing apparatus of the present invention can be introduced at a lower cost as compared to the CLC method using an ITM or R-ECM, can be applied both to polishing of a metal film and to polishing of an oxide film, and can polish the film on the substrate with stable polishing performance throughout the life of a polishing pad without involving a decrease in the throughput unlike the CLC method using an ITM.

DETAILED DESCRIPTION OF THE PREFERRED EMBODIMENTS

Figure 1:
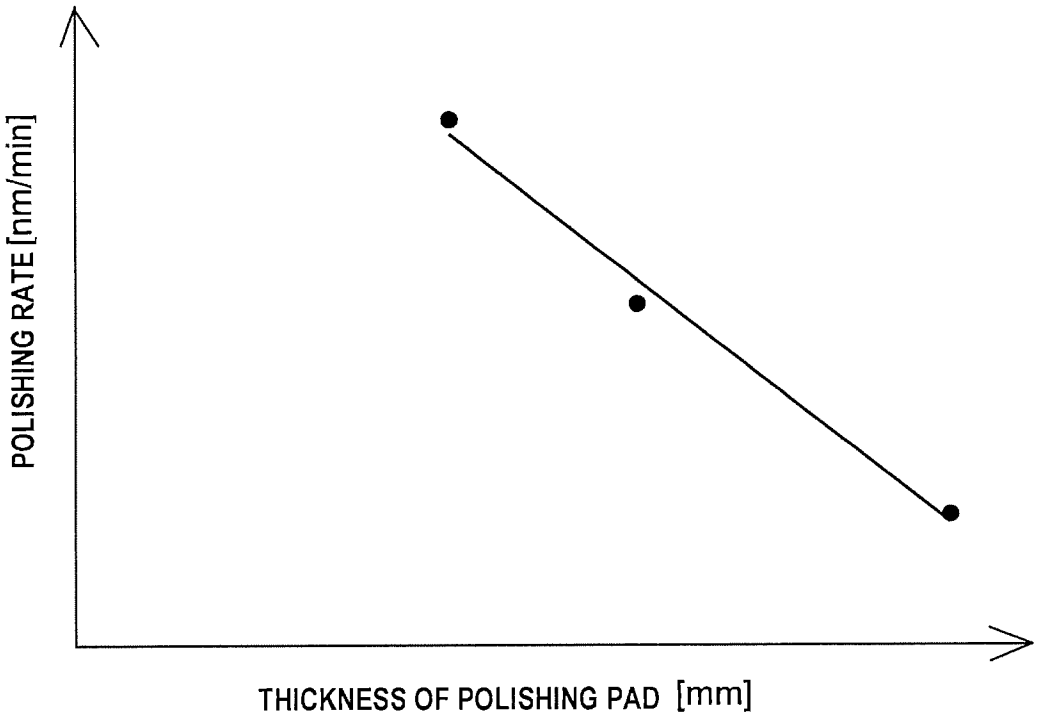
FIG. 1 is a graph showing an example of the relationship between a thickness of a polishing pad and a polishing rate in a polishing process.
Figure 2:
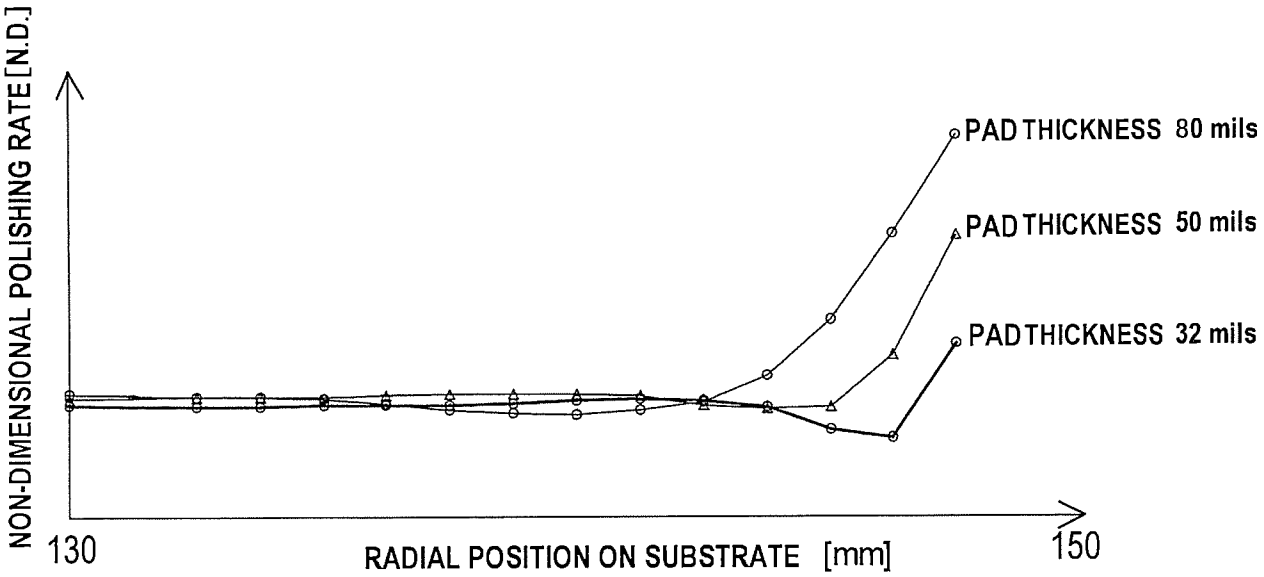
FIG. 2 is a graph showing an example of non-dimensional polishing rate with respect to radial positions on a substrate when the film on the substrate is polished by using polishing pads having different thicknesses.

A polishing method and a polishing apparatus according to embodiments of the present invention will be described below with reference to FIGS. 3 to 12. Identical or corresponding parts are denoted by identical reference numerals throughout drawings and will not be described in duplication.

Figure 3:
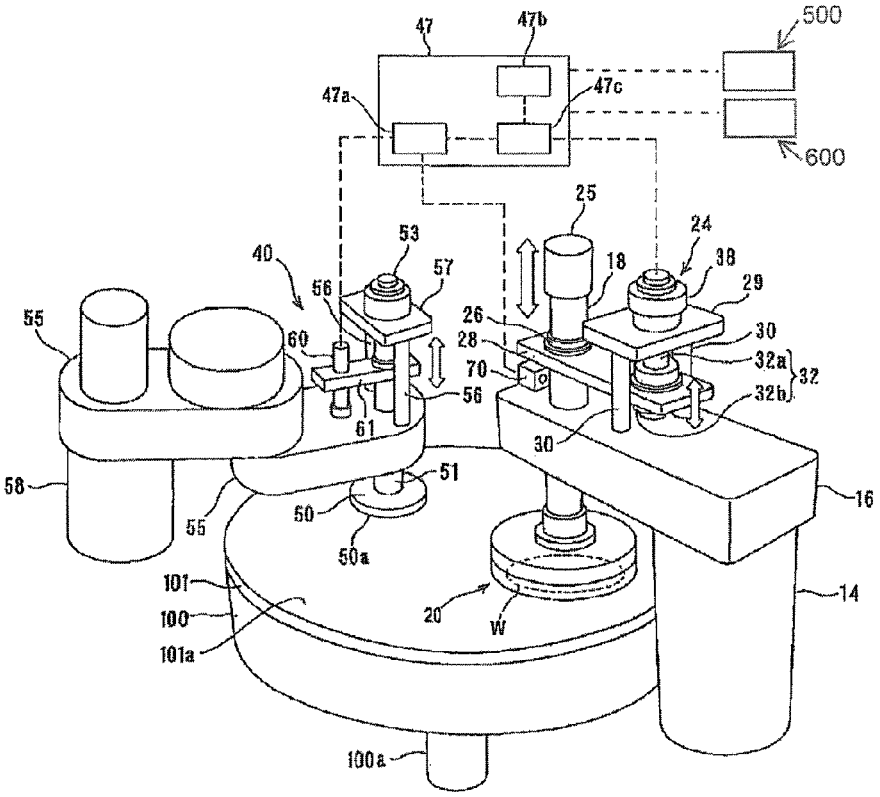
FIG. 3 is a schematic view of a polishing apparatus according to an embodiment of the present invention.

FIG. 3 is a schematic view showing an entire structure of a polishing apparatus according to an embodiment of the present invention. As shown in FIG. 3, the polishing apparatus comprises a polishing table 100, and a top ring 20 for holding a substrate W such as a semiconductor wafer as an object to be polished and pressing the substrate against a polishing surface on the polishing table 100.

The polishing table 100 is coupled via a table shaft 100*a* to a polishing table rotating motor (not shown) disposed below the polishing table 100. Thus, the polishing table 100 is rotatable about the table shaft 100*a*. A polishing pad 101 is attached to an upper surface of the polishing table 100. An upper surface 101*a* of the polishing pad 101 constitutes a polishing surface to polish a film formed on a surface of the substrate W. A polishing liquid supply nozzle (not shown) is provided above the polishing table 100 to supply a polishing liquid onto the polishing pad 101 on the polishing table 100.

The top ring 20 is connected to a top ring shaft 18, and the top ring shaft 18 is vertically movable with respect to a top ring head 16 by a vertically movable mechanism 24. When the vertically movable mechanism 24 moves the top ring shaft 18 vertically, the top ring 20 is lifted and lowered as a whole for positioning with respect to the top ring head 16. The top ring shaft 18 is rotatable by driving a top ring rotating motor (not shown). The top ring 20 is rotatable about an axis of the top ring shaft 18 by rotation of the top ring shaft 18. A rotary joint 25 is mounted on the upper end of the top ring shaft 18.

Various kinds of polishing pads are available on the market. For example, some of these are SUBA800, IC-1000, and IC-1000/SUBA400 (two-layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is made of rigid foam polyurethane (single layer). Foam polyurethane is porous and has a large number of fine recesses or holes formed in its surface.

The top ring 20 is configured to hold a substrate W such as a semiconductor wafer on its lower surface. The top ring head 16 is pivotable (swingable) about a support shaft 14. Thus, the top ring 20, which holds a substrate W on its lower surface, is moved between a position at which the top ring 20 receives the substrate and a position above the polishing table 100 by pivotal movement of the top ring head 16. The top ring 20 is lowered to press the substrate W against a surface (polishing surface) 101*a* of the polishing pad 101. At this time, while the top ring 20 and the polishing table 100 are respectively rotated, a polishing liquid is supplied onto the polishing pad 101 from the polishing liquid supply nozzle (not shown) provided above the polishing table 100. The substrate is brought into sliding contact with the polishing surface 101*a* on the polishing pad 101. Thus, the film formed on the surface of the substrate W is polished.

The vertically movable mechanism 24 for vertically moving the top ring shaft 18 and the top ring 20, has a bridge 28 for rotatably supporting the top ring shaft 18 via a bearing 26, a ball screw 32 mounted on the bridge 28, a support stage 29 supported by poles 30, and an AC servomotor 38 provided on the support stage 29. The support stage 29, which supports the servomotor 38, is fixed to the top ring head 16 via the poles 30.

The ball screw 32 has a screw shaft 32*a* which is coupled to the servomotor 38, and a nut 32*b* into which the screw shaft 32*a* is screwed. The top ring shaft 18 is configured to be vertically movable together with the bridge 28. Accordingly, when the servomotor 38 is driven, the bridge 28 is vertically moved through the ball screw 32. As a result, the top ring shaft 18 and the top ring 20 are vertically moved. The polishing apparatus has a distance measuring sensor 70 serving as a position detecting device for detecting the distance from the distance measuring sensor 70 to a lower surface of the bridge 28, i.e. the position of the bridge 28. By detecting the position of the bridge 28 by the distance measuring sensor 70, the position of the top ring 20 can be detected. The distance measuring sensor 70 constitutes the vertically movable mechanism 24 together with the ball screw 32 and the servomotor 38.

The distance measuring sensor 70 may comprise a laser sensor, an ultrasonic sensor, an eddy current sensor, or a linear scale sensor. The polishing apparatus has a controller 47 for controlling various equipment including the distance measuring sensor 70 and the servomotor 38 in the polishing apparatus. The controller 47 includes a memory unit 47*a*, a storage unit 47*b* and a calculation unit 47*c*.

The polishing apparatus has a dressing unit 40 for dressing the polishing surface 101*a* on the polishing pad 101. The dressing unit 40 includes a dresser 50 which is brought into sliding contact with the polishing surface 101*a* on the polishing pad 101, a dresser shaft 51 to which the dresser 50 is connected, an air cylinder 53 provided at an upper end of the dresser shaft 51, and a swing arm 55 for rotatably supporting the dresser shaft 51. The dresser 50 has a dressing member 50*a* attached on a lower portion of the dresser 50. The dressing member 50*a* has diamond particles in the form of needles. These diamond particles are attached on a lower surface of the dressing member 50*a*. The air cylinder 53 is disposed on a support stage 57, which is supported by poles 56. The poles 56 are fixed to the swing arm 55.

The swing arm 55 is pivotable (swingable) about the support shaft 58 by actuation of a motor (not shown). The dresser shaft 51 is rotatable by actuation of a motor (not shown). Thus, the dresser 50 is rotated about the dresser shaft 51 by rotation of the dresser shaft 51. The air cylinder 53 vertically moves the dresser 50 via the dresser shaft 51 so as to press the dresser 50 against the polishing surface 101*a* of the polishing pad 101 under a predetermined pressing force.

Dressing operation of the polishing surface 101*a* on the polishing pad 101 is performed as follows: The dresser 50 is pressed against the polishing surface 101*a* by the air cylinder 53. Simultaneously, pure water is supplied onto the polishing surface 101*a* from a pure water supply nozzle (not shown). In this state, the dresser 50 is rotated about the dresser shaft 51, and the lower surface (diamond particles) of the dressing member 50*a* is brought into contact with the polishing surface 101*a*. Thus, the dresser 50 removes a portion of the polishing pad 101 so as to dress the polishing surface 101*a*. In this manner, when the polishing surface 101*a* is dressed, a thickness of the polishing pad 101 is reduced (worn).

The polishing apparatus includes a displacement sensor 60 serving as a polishing pad measuring device for measuring an amount of wear of the polishing pad 101 by utilizing the dresser 50. Specifically, the displacement sensor (polishing pad measuring device) 60 is provided on an upper surface of the swing arm 55 of the dressing unit 40 to measure displacement of the dresser 50. A target plate 61 is fixed to the dresser shaft 51. The target plate 61 is vertically moved by vertical movement of the dresser 50. The displacement sensor 60 is inserted into a hole of the target plate 61. The displacement sensor 60 measures displacement of the target plate 61 to measure displacement of the dresser 50. The displacement sensor 60 may comprise any type of sensors including a linear scale sensor, a laser sensor, an ultrasonic sensor, and an eddy current sensor.

Figure 11B:
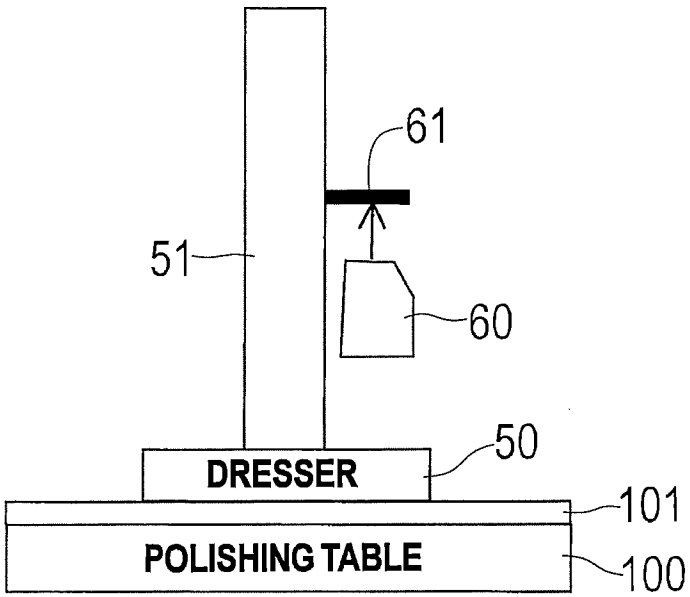
FIGS. 11A and 11B are schematic views showing the positional relationship between the displacement sensor, the target plate, the dresser, the polishing pad and the polishing table.
Figure 11A:
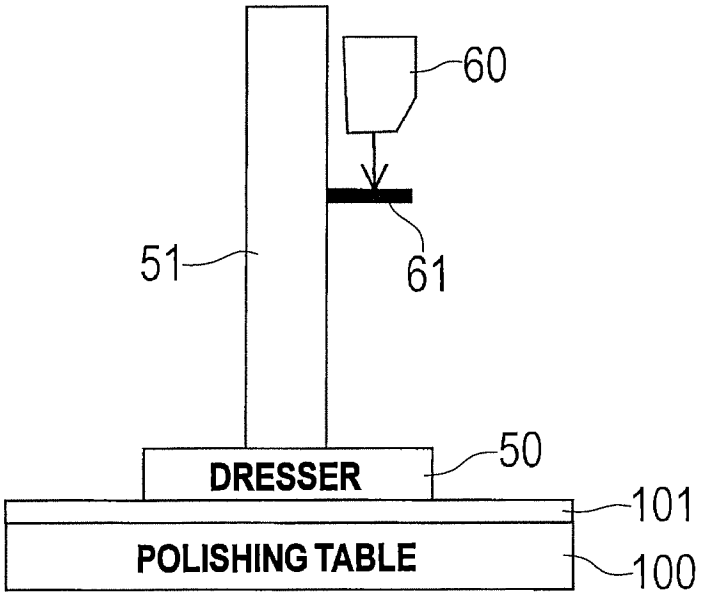

FIGS. 11A and 11B are schematic views showing the positional relationship between the displacement sensor 60, the target plate 61, the dresser 50, the polishing pad 101 and the polishing table 100. FIG. 11A is a view showing the case where the displacement sensor 60 is provided above the target plate 61, and FIG. 11B is a view showing the case where the displacement sensor 60 is provided below the target plate 61.

Figure 12A:
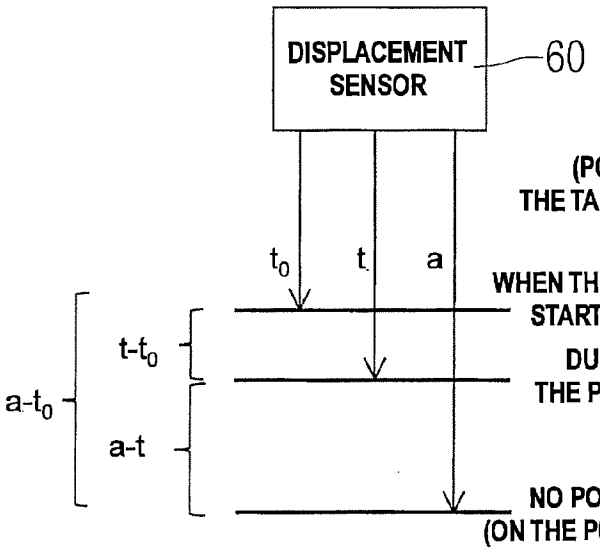
FIGS. 12A and 12B are schematic views showing the measurement directions of the dresser positions (positions of the polishing pad) in a vertical direction and measured values.
Figure 12B:
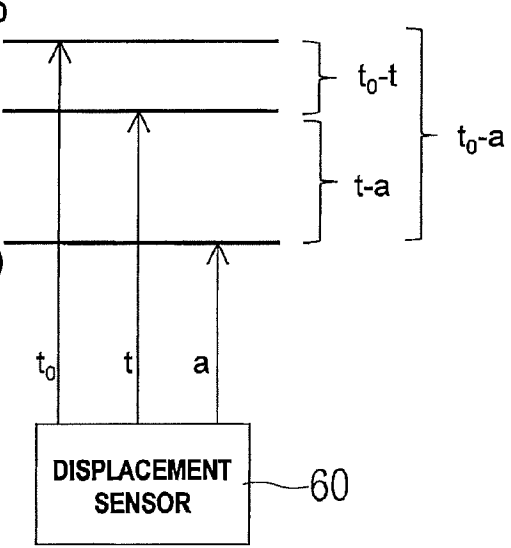

FIGS. 12A and 12B are schematic views showing the measurement directions of the dresser positions (positions of the polishing pad) in a vertical direction and measured values.

FIG. 12A shows the case where the displacement sensor 60 and the target plate 61 have the positional relationship shown in FIG. 11A, and FIG. 12B shows the case where the displacement sensor 60 and the target plate 61 have the positional relationship shown in FIG. 11B.

As shown in FIG. 12A, in the case where the displacement sensor 60 is provided above the target plate 61, the measurement directions of the dresser positions (positions of the polishing pad) in the vertical direction are indicated by down-pointing arrows. The reference position a of the dresser is a position of the target plate 61 when the polishing pad 101 is not provided on the polishing table 100. The initial position $t_0$ of the dresser (initial position $t_0$ of the polishing pad) is a position of the target plate 61 when the polishing pad 101 starts to be used. The position t of the dresser (position t of the polishing pad) is a position of the target plate 61 when the polishing pad is being used. The amount of wear (decrease in the thickness) of the polishing pad is indicated by $(t-t_0)$, the initial thickness of the polishing pad is indicated by $(a-t_0)$, and the thickness of the polishing pad is indicated by $(a-t)$.

As shown in FIG. 12B, in the case where the displacement sensor 60 is provided below the target plate 61, the measurement directions of the dresser positions (positions of the polishing pad) in the vertical direction are indicated by up-pointing arrows. The reference position a of the dresser is a position of the target plate 61 when the polishing pad 101 is not provided on the polishing table 100. The initial position $t_0$ of the dresser (initial position $t_0$ of the polishing pad) is a position of the target plate 61 when the polishing pad 101 starts to be used. The position t of the dresser (position t of the polishing pad) is a position of the target plate 61 when the polishing pad is being used. The amount of wear (decrease in the thickness) of the polishing pad is indicated by $(t_0-t)$, the initial thickness of the polishing pad is indicated by $(t_0-a)$, and the thickness of the polishing pad is indicated by $(t-a)$.

In the following controlling method, the case where the displacement sensor 60 is provided above the target plate 61 as shown in FIG. 11A will be described.

In the present embodiment, the amount of wear of the polishing pad 101 is measured as follows: First, the air cylinder 53 is operated to bring the dresser 50 into contact with the polishing surface 101*a* of an unused polishing pad 101 which has been replaced. In this state, the displacement sensor 60 detects an initial position $t_0$ of the dresser 50 (initial position $t_0$ of the polishing pad). The initial position $t_0$ of the dresser (initial position $t_0$ of the polishing pad) is such a position that the dresser vertical position when the polishing pad 101 is not attached to the polishing table 100 is taken as a reference position. The initial position $t_0$ of the polishing pad is a position of the polishing surface 101*a* of the polishing pad 101 in a vertical direction. The initial position $t_0$ of the dresser 50 (initial position $t_0$ of the polishing pad) is stored in the memory unit 47*a* of the controller 47. Then, after completion of a polishing process for polishing one or more substrates, and during dressing or after dressing of the polishing pad 101 by the dresser 50, the position t of the dresser 50 (position t of the polishing pad) is measured in such a state that the dresser 50 is brought into contact with the polishing surface 101*a*. The position t of the polishing pad is a position of the polishing surface 101*a* of the polishing pad 101 in the vertical direction. Since the position of the dresser 50 is displaced downward by the amount of wear (decrease in the thickness) of the polishing pad 101, the controller 47 calculates a difference $(t-t_0)$ between the initial position $t_0$ of the dresser 50 (initial position $t_0$ of the polishing pad) and the position t of the dresser 50 (position t of the polishing pad) after polishing and dressing to obtain the amount of wear of the polishing pad 101. In this manner, the amount of wear of the polishing pad 101 is determined based on the position of the dresser 50 detected by the displacement sensor 60.

Although the amount of wear of the polishing pad 101 is measured in this embodiment, the thickness of the polishing pad 101 may be measured.

The polishing pads do not always have a uniform initial thickness because of errors in manufacturing polishing pads, and thus it is preferable to perform a feedforward control by measuring the thickness of the polishing pad in order to remove effects of variation of the initial thickness of the polishing pad. The thickness of the polishing pad 101 is measured as follows: The vertical position a of the dresser 50 when the dresser 50 is brought into contact with the surface of the polishing table 100 to which the polishing pad 101 is not attached is measured by the displacement sensor 60. Then, as with the case where the amount of wear of the polishing pad is measured, the vertical initial position $t_0$ of the polishing pad and the vertical position t of the polishing pad are measured. The initial thickness of the polishing pad is indicated by $(a-t_0)$, and the thickness of the polishing pad is indicated by $(a-t)$ (see FIG. 12A).

The initial thickness $(a-t_0)$ of the polishing pad 101 is stored in the memory unit 47*a* of the controller 47.

Next, the top ring 20 shown in FIG. 3 will be described in more detail. FIGS. 4 through 7 are cross-sectional views showing the top ring 20 along a plurality of radial directions of the top ring 20.

As shown in FIGS. 4 through 7, the top ring 20 has a top ring body 200 for pressing a substrate W against the polishing surface 101*a*, and a retainer ring 302 for directly pressing the polishing surface 101*a*. The top ring body 200 includes an upper member 300 in the form of a circular plate, an intermediate member 304 attached to a lower surface of the upper member 300, and a lower member 306 attached to a lower surface of the intermediate member 304. The retainer ring 302 is attached to a peripheral portion of the upper member 300 of the top ring body 200. The upper member 300 is connected to the top ring shaft 18 by bolts 308. Further, the intermediate member 304 is fixed to the upper member 300 by bolts (not shown), and the lower member 306 is fixed to the upper member 300 by bolts (not shown). The top ring body 200 comprising the upper member 300, the intermediate member 304, and the lower member 306 is made of resin such as engineering plastics (e.g. PEEK).

The top ring 20 has an elastic membrane 314 attached to a lower surface of the lower member 306. The elastic membrane 314 is brought into contact with a rear face of a substrate W held by the top ring 20. The elastic membrane 314 is held on the lower surface of the lower member 306 by an annular edge holder 316 disposed radially outward, and annular ripple holders 318 and 319 disposed radially inward of the edge holder 316. The elastic membrane 314 is made of a highly strong and durable rubber material such as ethylene propylene rubber (EPDM), polyurethane rubber, silicone rubber, or the like.

The edge holder 316 is held by the ripple holder 318, and the ripple holder 318 is held on the lower surface of the lower member 306 by a plurality of stoppers 320. The ripple holder 319 is held on the lower surface of the lower member 306 by a plurality of stoppers 322.

Figure 4:
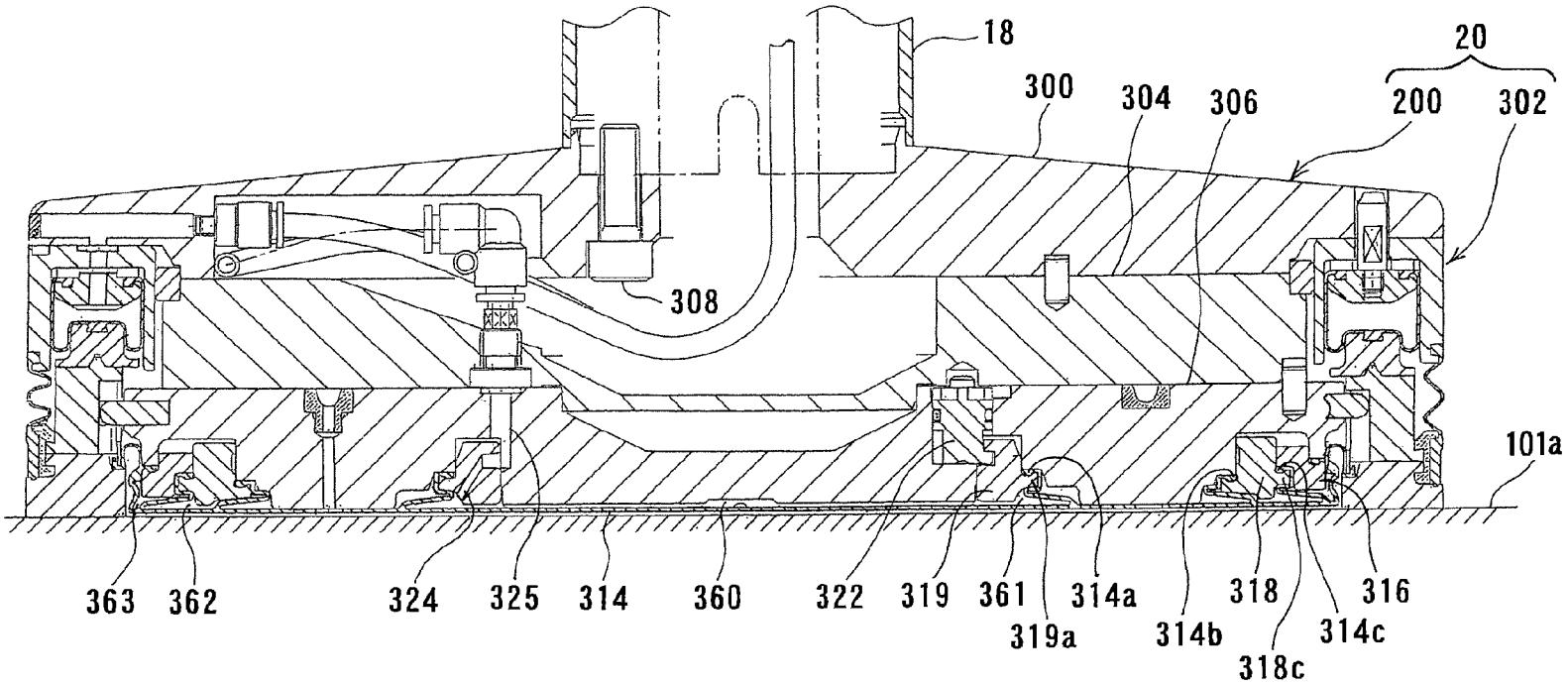
FIG. 4 is a cross-sectional view of the top ring shown in FIG. 3.

As shown in FIG. 4, a central chamber 360 is formed at a central portion of the elastic membrane 314. The ripple holder 319 has a passage 324 communicating with the central chamber 360. The lower member 306 has a passage 325 communicating with the passage 324. The passage 324 of the ripple holder 319 and the passage 325 of the lower member 306 are connected to a fluid supply source (not shown). Thus, a pressurized fluid is supplied through the passages 325 and 324 to the central chamber 360 formed by the elastic membrane 314.

The ripple holder 318 has claws 318*b*, 318*c* for pressing a ripple 314*b* and an edge 314*c* of the elastic membrane 314 against the lower surface of the lower member 306, respectively. The ripple holder 319 has a claw 319*a* for pressing a ripple 314*a* of the elastic membrane 314 against the lower surface of the lower member 306.

Figure 5:
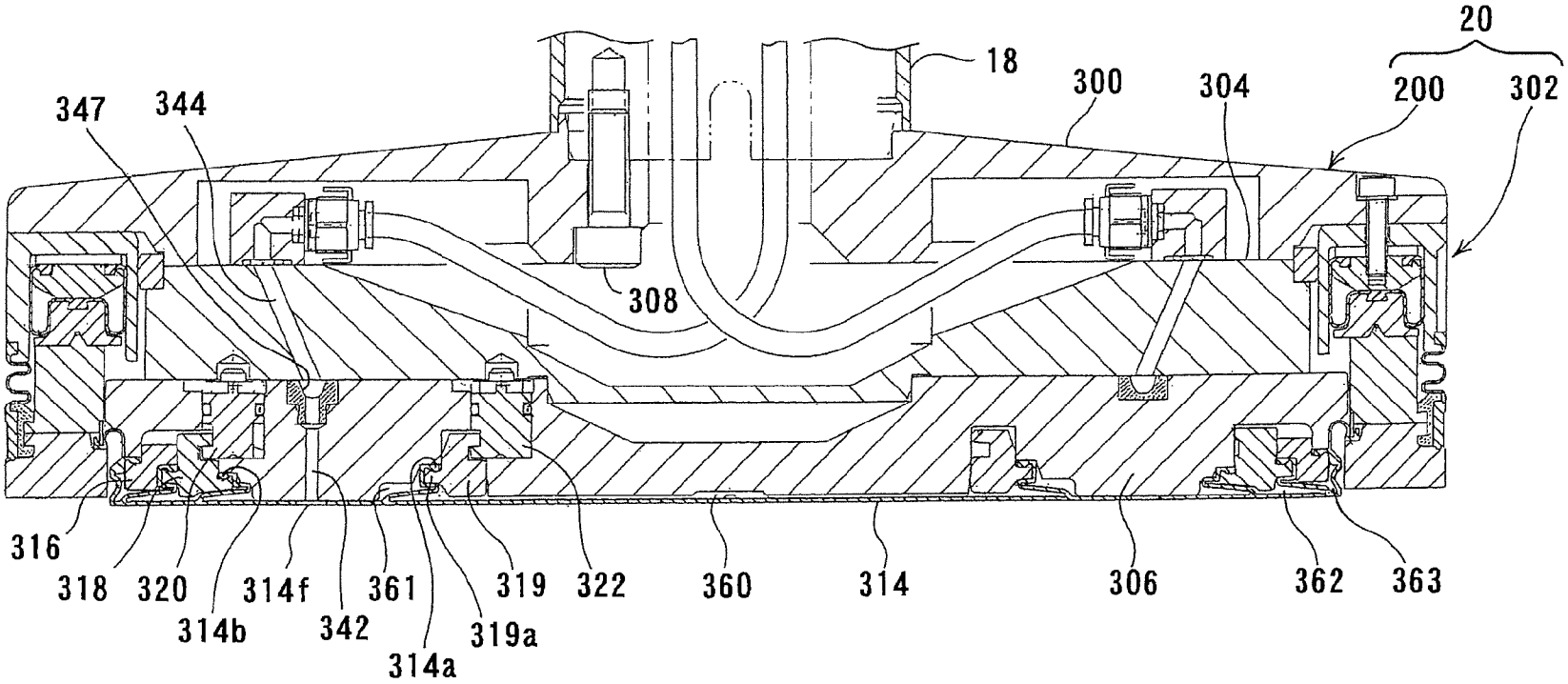
FIG. 5 is another cross-sectional view of the top ring shown in FIG. 3.

As shown in FIG. 5, an annular ripple chamber 361 is formed between the ripple 314*a* and the ripple 314*b* of the elastic membrane 314. A gap 314*f* is formed between the ripple holder 318 and the ripple holder 319 of the elastic membrane 314. The lower member 306 has a passage 342 communicating with the gap 314*f*. Further, the intermediate member 304 has a passage 344 communicating with the passage 342 of the lower member 306. An annular groove 347 is formed at a connecting portion between the passage 342 of the lower member 306 and the passage 344 of the intermediate member 304. The passage 342 of the lower member 306 is connected via the annular groove 347 and the passage 344 of the intermediate member 304 to a fluid supply source (not shown). Thus, a pressurized fluid is supplied through the passages to the ripple chamber 361. Further, the passage 342 is selectively connected to a vacuum pump (not shown). When the vacuum pump is operated, a substrate such as a semiconductor wafer is attached to the lower surface of the elastic membrane 314 by vacuum suction.

Figure 6:
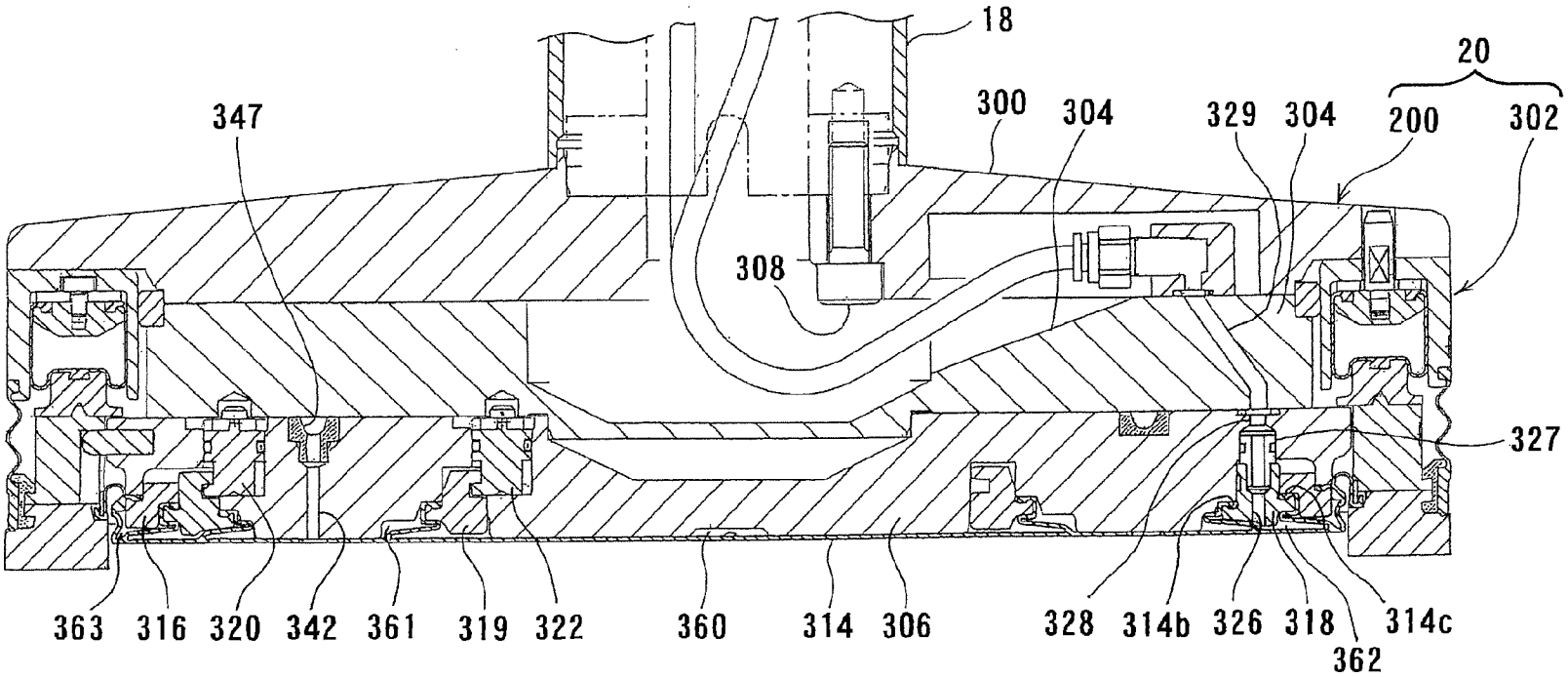
FIG. 6 is yet another cross-sectional view of the top ring shown in FIG. 3.

As shown in FIG. 6, the ripple holder 318 has a passage 326 communicating with an annular outer chamber 362 formed by the ripple 314*b* and the edge 314*c* of the elastic membrane 314. Further, the lower member 306 has a passage 328 communicating with the passage 326 of the ripple holder 318 via a connector 327. The intermediate member 304 has a passage 329 communicating with the passage 328 of the lower member 306. The passage 326 of the ripple holder 318 is connected via the passage 328 of the lower member 306 and the passage 329 of the intermediate member 304 to a fluid supply source (not shown). Thus, a pressurized fluid is supplied through the passages 329, 328, and 326 to the outer chamber 362 formed by the elastic membrane 314.

Figure 7:
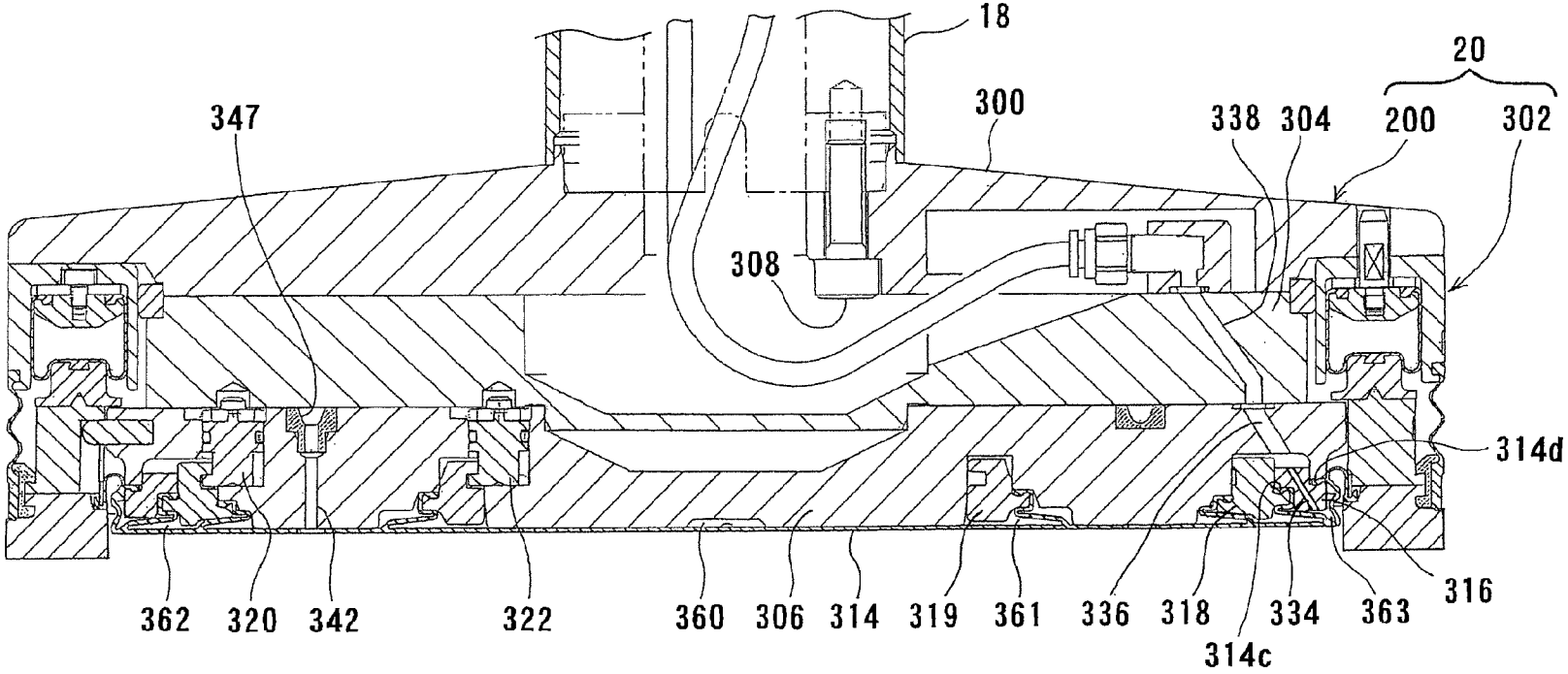
FIG. 7 is yet another cross-sectional view of the top ring shown in FIG. 3.

As shown in FIG. 7, the edge holder 316 has a claw for holding an edge 314*d* of the elastic membrane 314 on the lower surface of the lower member 306. The edge holder 316 has a passage 334 communicating with an annular edge chamber 363 formed by the edges 314*c* and 314*d* of the elastic membrane 314. The lower member 306 has a passage 336 communicating with the passage 334 of the edge holder 316. The intermediate member 304 has a passage 338 communicating with the passage 336 of the lower member 306. The passage 334 of the edge holder 316 is connected via the passage 336 of the lower member 306 and the passage 338 of the intermediate member 304 to a fluid supply source. Thus, a pressurized fluid is supplied through the passages 338, 336, and 334 to the edge chamber 363 formed by the elastic membrane 314.

As described above, according to the top ring 20 in the present embodiment, pressing forces for pressing a substrate against the polishing pad 101 can be adjusted at local areas of the substrate by adjusting pressures of fluids to be supplied to the respective pressure chambers (i.e. the central chamber 360, the ripple chamber 361, the outer chamber 362, and the edge chamber 363) formed between the elastic membrane 314 and the lower member 306.

Figure 8:
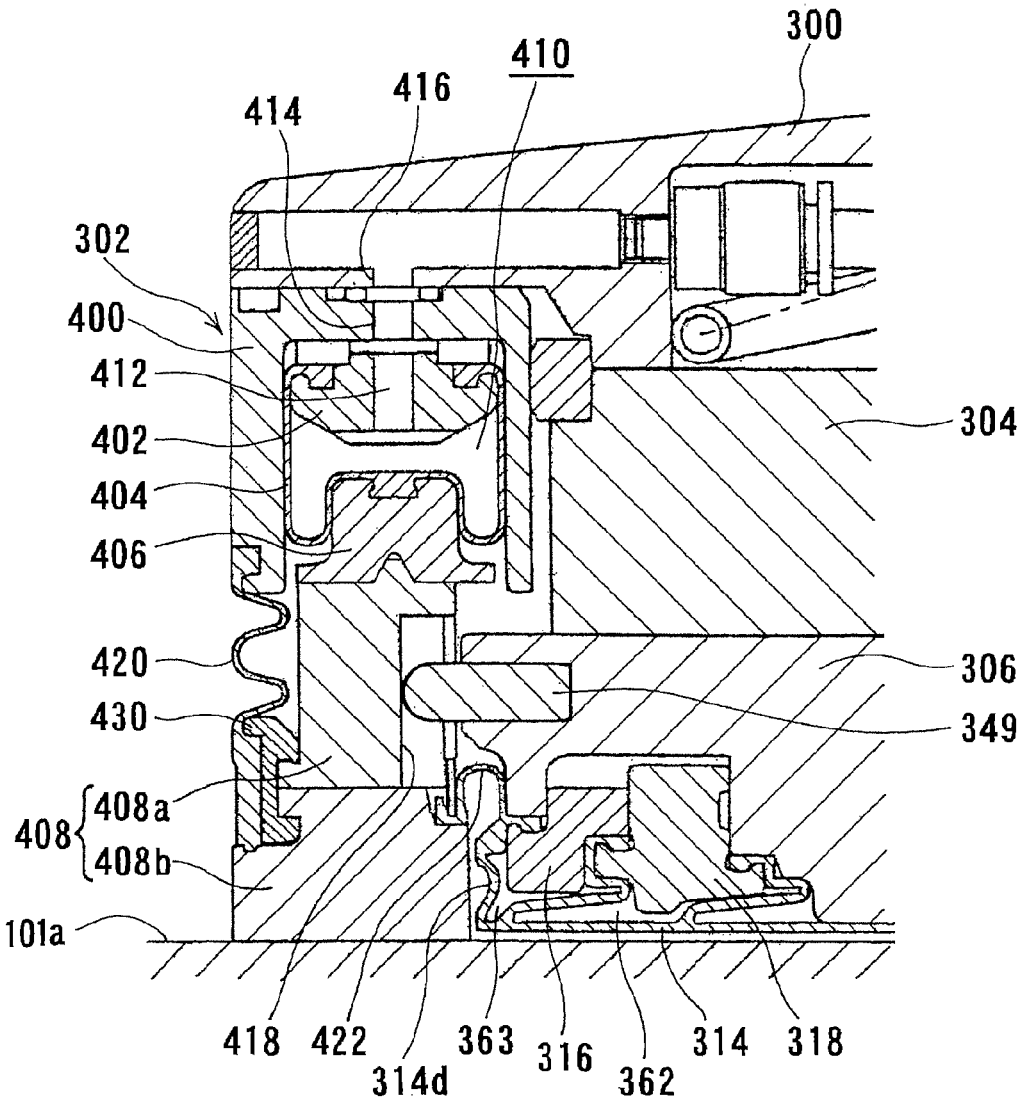
FIG. 8 is an enlarged view of the retainer ring shown in FIG. 3.

FIG. 8 is an enlarged view of the retainer ring shown in FIG. 4. The retainer ring 302 serves to hold a peripheral edge of a substrate. As shown in FIG. 8, the retainer ring 302 has a cylinder 400 having a cylindrical shape, a holder 402 attached to an upper portion of the cylinder 400, an elastic membrane 404 held in the cylinder 400 by the holder 402, a piston 406 connected to a lower end of the elastic membrane 404, and a ring member 408 which is pressed downward by the piston 406. A connection sheet 420, which can be expanded and contracted in a vertical direction, is provided between an outer circumferential surface of the ring member 408 and a lower end of the cylinder 400. The connection sheet 420 is disposed so as to fill a gap between the ring member 408 and the cylinder 400. Thus, the connection sheet 420 serves to prevent a polishing liquid (slurry) from being introduced into the gap between the ring member 408 and the cylinder 400.

The elastic membrane 314 includes a seal portion 422 connecting the elastic membrane 314 to the retainer ring 302 at an edge (periphery) 314*d* of the elastic membrane 314. The seal portion 422 has a shape curved upward. The seal portion 422 is disposed so as to fill a gap between the elastic membrane 314 and the ring member 408. The seal portion 422 is made of a deformable material. The seal portion 422 serves to prevent a polishing liquid from being introduced into the gap between the elastic membrane 314 and the ring member 408 while allowing the top ring body 200 and the retainer ring 302 to be moved relative to each other. In the present embodiment, the seal portion 422 is formed integrally with the edge 314*d* of the elastic membrane 314 and has a U-shaped cross-section.

If the connection sheet 420 or the seal portion 422 is not provided, a polishing liquid may be introduced into an interior of the top ring 20 so as to inhibit normal operation of the top ring body 200 and the retainer ring 302 of the top ring 20. In the present embodiment, the connection sheet 420 and the seal portion 422 prevent a polishing liquid from being introduced into the interior of the top ring 20. Accordingly, it is possible to operate the top ring 20 normally. The elastic membrane 404, the connection sheet 420, and the seal portion 422 are made of a highly strong and durable rubber material such as ethylene propylene rubber (EPDM), polyurethane rubber, silicone rubber, or the like.

The ring member 408 is divided into an upper ring member 408*a* and a lower ring member 408*b*. The upper ring member 408*a* is brought into contact with the piston 406. The lower ring member 408*b* is brought into contact with the polishing surface 101*a*. The upper ring member 408*a* and the lower ring member 408*b* have flange portions extending in a circumferential direction on outer circumferential surfaces of the ring members 408*a* and 408*b*. The flange portions are held by a clamp 430 so that the upper ring member 408*a* and the lower ring member 408*b* are fastened. The clamp 430 is made of a flexible material. An initial shape of the clamp 430 is substantially linear. When the clamp 430 is attached to the flange portions of the ring member 408, the clamp 430 is deformed into an annular shape having a notch.

As shown in FIG. 8, the holder 402 has a passage 412 communicating with a chamber 410 formed by the elastic membrane 404. The cylinder 400 has a passage 414 formed at an upper portion thereof. The passage 414 of the cylinder 400 communicates with the passage 412 of the holder 402. The upper member 300 has a passage 416 communicating with the passage 414 of the cylinder 400. The passage 412 of the holder 402 is connected via the passage 414 of the cylinder 400 and the passage 416 of the upper member 300 to a fluid supply source (not shown). Thus, a pressurized fluid is supplied through the passages 416, 414, and 412 to the pressure chamber 410. Accordingly, by adjusting a pressure of a fluid to be supplied to the pressure chamber 410, the elastic membrane 404 can be expanded and contracted so as to vertically move the piston 406. Thus, the ring member 408 of the retainer ring 302 can be pressed against the polishing pad 101 under a desired pressure.

In the illustrated example, the elastic membrane 404 employs a rolling diaphragm formed by an elastic membrane having bent portions. When an inner pressure in a chamber defined by the rolling diaphragm is changed, the bent portions of the rolling diaphragm are rolled so as to widen the chamber. The diaphragm is not brought into sliding contact with outside components and is hardly expanded and contracted when the chamber is widened. Accordingly, friction due to sliding contact can extremely be reduced, and a lifetime of the diaphragm can be prolonged. Further, pressing forces under which the retainer ring 302 presses the polishing pad 101 can accurately be adjusted.

With the above arrangement, only the ring member 408 of the retainer ring 302 can be lowered. Accordingly, a constant distance can be maintained between the lower member 306 and the polishing pad 101 even if the ring member 408 of the retainer ring 302 is worn out. Further, since the ring member 408, which is brought into contact with the polishing pad 101, and the cylinder 400 are connected by the deformable elastic membrane 404, no bending moment is produced by offset loads. Accordingly, surface pressures by the retainer ring 302 can be made uniform, and the retainer ring 302 becomes more likely to follow the polishing pad 101.

As shown in FIG. 8, the upper ring member 408*a* has a plurality of vertically extending V-shaped grooves 418. The V-shaped grooves 418 are formed in an inner surface of the upper ring member 408*a* at equal intervals. Further, a plurality of pins 349 project radially outward from a peripheral portion of the lower member 306. The pins 349 are arranged so as to engage with the V-shaped grooves 418 of the ring member 408. The pins 349 are vertically slidable within the V-shaped grooves 418 relative to the ring member 408. The pins 349 allow rotation of the top ring body 200 to be transmitted via the upper member 300 and the lower member 306 to the retainer ring 302 so as to integrally rotate the top ring body 200 and the retainer ring 302. Such an arrangement prevents torsion of the elastic membrane (rolling diaphragm) 404 and allows the ring member 408 to be pressed uniformly and smoothly against the polishing surface 101*a* during polishing. Further, a lifetime of the elastic membrane 404 can be prolonged.

As described above, pressing forces to press the substrate are controlled by pressures of fluids to be supplied to the central chamber 360, the ripple chamber 361, the outer chamber 362, and the edge chamber 363 formed by the elastic membrane 314. Accordingly, the lower member 306 should be located away upward from the polishing pad 101 during polishing. However, if the retainer ring 302 is worn out, a distance between the substrate and the lower member 306 is varied to change a deformation manner of the elastic membrane 314. Accordingly, surface pressure distribution is also varied on the substrate. Such a variation of the surface pressure distribution causes unstable profiles of polished semiconductor substrates.

In the illustrated example, since the retainer ring 302 can vertically be moved independently of the lower member 306, a constant distance can be maintained between the substrate and the lower member 306 even if the ring member 408 of the retainer ring 302 is worn out. Accordingly, profiles of polished substrates can be stabilized.

In the illustrated example, the elastic membrane 314 is disposed so as to be brought into contact with substantially the entire surface of the substrate. However, the elastic membrane 314 may be brought into contact with at least a portion of the substrate.

The dresser 50 scrapes off the polishing surface 101*a* of the polishing pad 101 by bringing the needle-like diamond particles, attached to the lower surface of the dresser 50, into sliding contact with the polishing pad 101. Accordingly, the diamond particles gradually wear out during dressing of the polishing surface 101*a*. A preferable surface roughness of the polishing surface 101*a* cannot be obtained if the diamond particles have worn out to a certain extent. Consequently, the amount of abrasive particles held on the polishing pad 101*a* is reduced, and a normal polishing process cannot be performed.

The amount of the polishing pad 101 cut off by the dresser 50 per unit time (hereinafter referred to as "cut rate") depends on the pressing force of the dresser 50 applied to the polishing surface 101*a* and the shape of the diamond particles. Thus, when dressing of the polishing surface 101*a* is carried under the conditions of constant pressing force by the dresser 50, the cut rate decreases as the diamond particles wear out. As described above, in this embodiment, the cut rate (i.e. the displacement of the polishing surface 101*a* per unit time) is measured by means of the displacement sensor 60.

Based on an output signal (measurement value) from the displacement sensor 60, the controller 47 calculates the cut rate of the polishing pad 101, i.e. the displacement of the polishing surface 101*a* per unit time (the amount of wear of the polishing pad 101).

Figure 9:
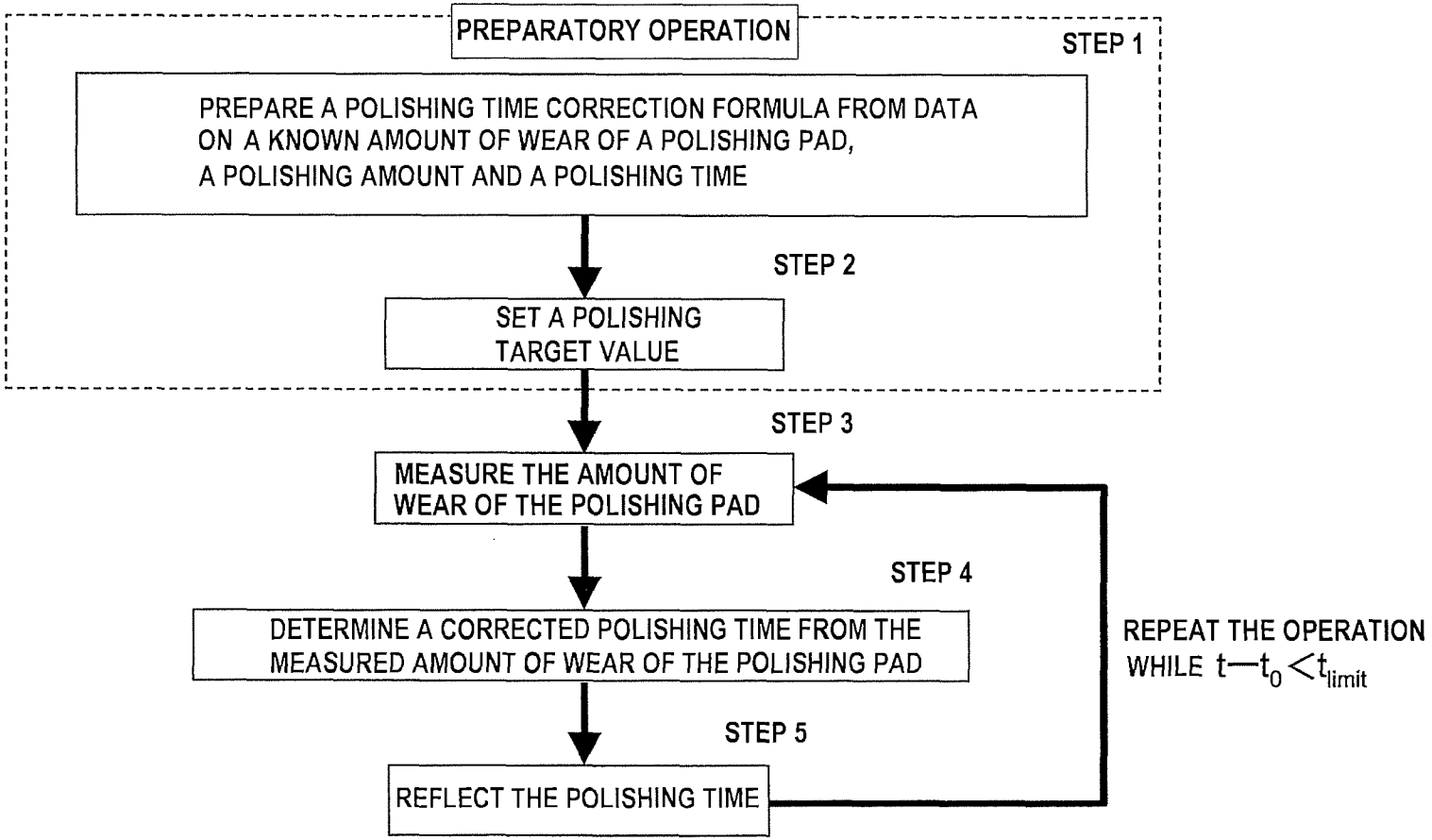
FIG. 9 is a flow chart of a feedforward control process for actually measuring the amount of wear of a polishing pad used for polishing and controlling a polishing time based on the information about the amount of wear of the polishing pad.

A feedforward control process for actually measuring the amount of wear of the polishing pad 101 used for polishing and controlling the polishing time based on the information about the amount of wear of the polishing pad 101, will now be described with reference to FIG. 9. In the following example, a second-order polynomial, using the actual amount of wear of the polishing pad as a variable, is used as an algorithm for correction of the polishing time. A first-order polynomial or a third-order or higher-order polynomial, using the actual amount of wear of the polishing pad as a variable, or a table showing the relationship between the actual amount of wear of the polishing pad and the (estimated) polishing time may also be used as an algorithm for correction of the polishing time.

First, in a preparatory operation, a polishing pad which is the same type of polishing pad used for polishing is used to polish a film formed on a substrate or films formed on substrates and the polishing pad is dressed after polishing, and an amount of wear of the polishing pad is measured. Further, a polishing time required to polish a predetermined polishing amount of the film or a polishing amount when the film is polished by a predetermined polishing time by the polishing pad whose amount of wear has been measured is measured. In this manner, at least three sets of the amount of wear of the polishing pad, the polishing amount and the polishing time are prepared as known data. Here, a predetermined polishing amount or a predetermined polishing time refers to a polishing amount or a polishing time serving as the criteria used when the polishing time correction formula is determined. Then, a polishing time correction formula, using the amount of wear of the polishing pad as a variable, is determined from these data (step 1). The amount of wear of the polishing pad as the known data refers to the difference between the initial position $t_0$ of the polishing pad immediately after replacement of the polishing pad and the position t of the polishing pad after polishing and dressing, i.e. $t-t_0$ (known value). The polishing amount of the film as the known data refers to the difference between the initial thickness $THK_I$ of the film to be polished and the final thickness $THK_f$ of the film after polishing, i.e. $THK_I-THK_f$. The polishing time as the known data refers to the time required to polish the film on the substrate into the final thickness.

Specifically, the polishing rate PR and the amount of wear of the polishing pad, i.e. $t-t_0$, satisfy the relation of the following formula (1), and the polishing time PT and the polishing amount PQ satisfy the relation of the following formula (2):

$$PR=A(t-t_0)^2+B(t-t_0)+C \quad (1)$$

$$PT=PQ/PR=PQ/\{A(t-t_0)^2+B(t-t_0)+C\} \quad (2)$$

The constants A, B and C of the formula (1) can be determined from the at least three sets of data on the known amount of wear of the polishing pad, the known polishing amount and the known polishing time. Then, the polishing time correction formula (2), using the amount of wear of the polishing pad ($t-t_0$) as a variable, can be determined. The formula (2) is stored in the storage unit 47*b* of the controller 47.

Next, a polishing target value is set for the film to be polished (step 2), and the polishing target value is stored in the memory unit 47*a* of the controller 47. In this embodiment, a polishing amount PQ (set value) is directly set as a polishing target value. The final thickness of the film after polishing may be set as a polishing target value. In this case, the polishing amount can be determined by subtracting the final thickness of the film from the initial thickness of the film. The initial thickness of the film may be measured with a film thickness sensor (not shown) installed in the polishing apparatus, or may be obtained by receiving data measured in advance outside the apparatus. At this stage, the preparatory operation is finished.

On the other hand, in the polishing apparatus, the initial position $t_0$ (measured value) of the polishing pad 101 immediately after replacement of the polishing pad is measured by a film thickness measuring device 500 (as shown in FIG. 3) through measurement of the initial position of the dresser 50, as described above. The initial position $t_0$ (measured value) of the polishing pad 101 is stored in the memory unit 47 a of the controller 47. Then, the position t (measured value) of the polishing pad 101 after actual polishing of the substrate (s), and during dressing or after dressing of the polishing pad 101 by the dresser 50 is measured e.g. at regular intervals, and the amount of wear of the polishing pad 101, i.e. $t-t_0$ (measured value), is obtained by subtracting the initial position $t_0$ (measured value) of the polishing pad 101 stored in the memory unit 47 a from the measured position t (step 3).

Next, the polishing time correction formula (2), stored in the storage unit 47*b*, is drawn to the calculation unit 47*c*, where the polishing amount PQ (set value) as a polishing target value is assigned to "PQ" in the formula (2), and the actually measured amount of wear of the polishing pad 101, i.e. $t-t_0$ (measured value), is assigned to "$(t-t_0)$" in the formula (2), thereby determining the polishing time PT (step 4).

Then, the film on the substrate is polished by the polishing apparatus while reflecting the polishing time PT obtained in the step 4 (step 5). Thus, the feedforward control which can change the polishing time appropriately according to the amount of wear (decrease in the thickness) of the polishing pad 101 when the thickness of the polishing pad 101 has decreased (worn) by dressing of the polishing pad 101 can be performed.

Then, in the case where a limit amount of wear of the polishing pad is expressed as $t_{limit}$, while the amount of wear of the polishing pad, i.e. $t-t_0$ (measured value) is smaller than the limit amount $t_{limit}$[$(t-t_0)<t_{limit}$], the above operation from the step 3 to the step 5 is repeated. When the amount of wear of the polishing pad reaches the limit amount $t_{limit}$, the polishing pad is replaced with a new one.

The cut rate of the polishing pad 101 in dressing of the polishing pad 101 by the dresser 50 may be determined from the dressing time, and the cut rate of the polishing pad 101 may be reflected in the polishing time. This can enhance the accuracy of estimation of the polishing time.

Further, when the film on the substrate W is polished by pressing the substrate W against the polishing pad 101, the retainer ring 302, which surrounds the periphery of the substrate W, presses the polishing pad 101. In this case, the pressing force of the retainer ring 302 applied to the polishing pad 101 may be reflected in the polishing time for polishing the film. This can enhance the accuracy of estimation of the polishing time.

Further, the results of the feedforward control (the amount of wear of the polishing pad, the polishing amount and the polishing time) may be measured at certain intervals, and a self-correction function that can make a correction to the algorithm for correction of the polishing time may be provided in the feedforward control.

In above embodiment, the polishing time correction formula, using the amount of wear of a polishing pad as a variable, is determined from the data obtained as known data on the amount of wear of the polishing pad, and the polishing amount and the polishing time. However, it is also possible to use the number of substrates that have been polished on the same polishing pad or the accumulated dressing time for the polishing pad as the known data, instead of the amount of wear of the polishing pad. An algorithm for correction of polishing time (e.g. a polishing time correction formula) may be determined from the relationship between the number of substrates that have been polished on the same polishing pad or the accumulated dressing time for the polishing pad as the known data, and a polishing time required to polish a predetermined polishing amount of the film by the polishing pad which has processed the known number of substrates or by the polishing pad which has been dressed by the known accumulated dressing time, and the above predetermined polishing amount, or the relationship between the number of substrates that have been polished on the same polishing pad or the accumulated dressing time for the polishing pad as the known data, and a polishing amount obtained when the substrate is polished by a predetermined polishing time by the polishing pad which has processed the known number of substrates or by the polishing pad which has been dressed by the known accumulated dressing time, and the above predetermined polishing time. Here, a predetermined polishing amount or a predetermined polishing time refers to a polishing amount or a polishing time serving as the criteria used when the polishing time correction formula is determined.

In that case, a polishing target value (e.g. polishing amount) is set for the film to-be-polished. Then, the number of substrates that have been polished on the same polishing pad or the accumulated dressing time for the polishing pad is actually measured, and the optimal polishing time for the polishing target value (e.g. polishing amount) is determined from the measured value of the number of the polished substrate or the accumulated dressing time and the algorithm for correction of polishing time (e.g. a polishing time correction formula). Then, the film on the substrate is polished by the polishing apparatus while reflecting the optimal polishing time. In this case also, the feedforward control which can change the polishing time appropriately according to the amount of wear (decrease in the thickness) of the polishing pad 101 when the thickness of the polishing pad 101 has decreased by dressing of the polishing pad 101 can be performed. According to this feedforward control process, the polishing pad measuring device such as the displacement sensor 60 can be eliminated.

The thickness of the polishing pad 101 may be actually measured instead of the amount of wear of the polishing pad, the feedforward control for controlling the polishing time on the basis of the information about measurement may be performed. A polynomial using the actual thickness of the polishing pad as a variable, or a table showing the relationship between the actual thickness of the polishing pad and the (estimated) polishing time may also be used as an algorithm for correction of the polishing time.

Figure 10:
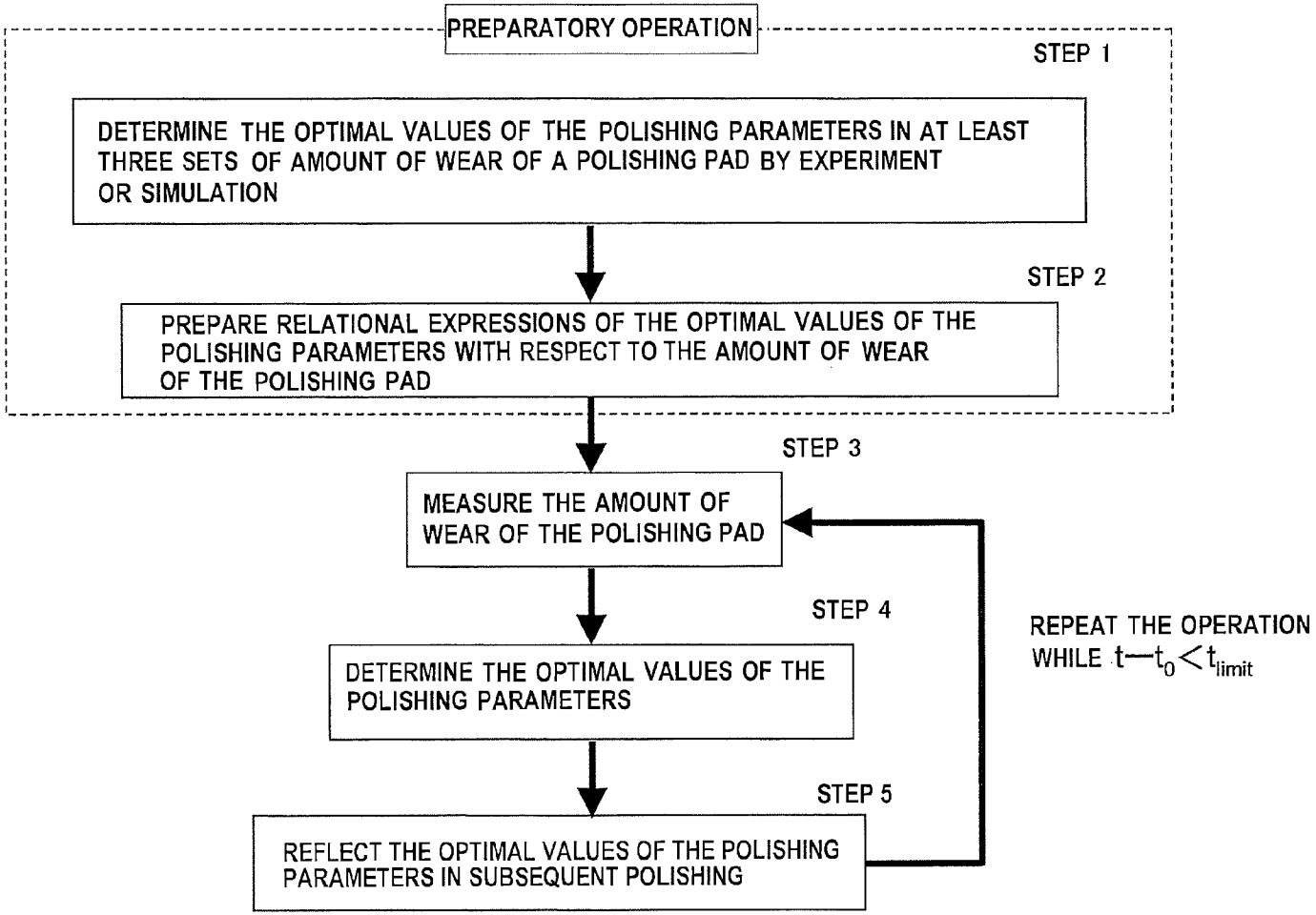
FIG. 10 is a flow chart pf a feedforward control process for actually measuring the amount of wear of a polishing pad used for polishing and controlling the polishing conditions such as the polishing pressure based on the information about the amount of wear of the polishing pad.

A feedforward control process for actually measuring the amount of wear of the polishing pad 101 used for polishing and controlling the polishing conditions such as the polishing pressure based on the information about the amount of wear of the polishing pad, will now be described with reference to FIG. 10. In the following example, a second-order polynomial, using the actual amount of wear of the polishing pad as a variable, is used as an algorithm for correction of polishing conditions. A first-order polynomial or a third-order or higher-order polynomial, using the actual amount of wear of the polishing pad as a variable, or a table showing the relationship between the actual amount of wear of the polishing pad and the (estimated) polishing time may also be used, as with the above embodiment.

In this example, the following six parameters as polishing parameters are used for the polishing conditions for polishing a film on a substrate W by pressing the substrate W against the polishing pad 101. Of these polishing parameters, only some arbitrary ones may be controlled.

(1) RRP: The retainer ring pressure which is a pressing force of the retainer ring 302, surrounding the periphery of the substrate W, on the polishing pad 101;

(2) CAP: The center chamber pressure for pressing a central area of the substrate W which corresponds to the center chamber 360 formed in the central part of the elastic membrane 314;

(3) RAP: The ripple chamber pressure for pressing an annular area of the substrate W which corresponds to the annular ripple chamber 361 formed between the ripple 314*a* and the ripple 314*b* of the elastic membrane 314;

(4) OAP: The outer chamber pressure for pressing an annular area of the substrate W which corresponds to the annular outer chamber 362 formed between the ripple 314*b* and the edge 314*c* of the elastic membrane 314;

(5) EAP: The edge chamber pressure for pressing an annular area of the substrate W which corresponds to the annular edge chamber 363 formed between the edge 314*c* and the edge 314*d* of the elastic membrane 314; and (6) MH: The elastic membrane height (head height) defined by the gap formed between the substrate W and the polishing surface 101*a* when the substrate W is held, on the elastic membrane 314, by vacuum attraction.

The optimal values of the polishing parameters are determined in at least three sets of known amount of wear of a polishing pad by experiment or simulation (step 1). By using the optimal values of the polishing parameters thus determined, relational expressions (polishing condition correction formulae) of the optimal values of the polishing parameters with respect to the known amount of wear of the polishing pad are prepared (step 2). As with the preceding embodiment, the known amount of wear of the polishing pad refers to the difference between the initial position $t_0$ of the polishing pad immediately after replacement of the polishing pad and the position t of the polishing pad after polishing of the substrate(s), and during dressing or after dressing of the polishing pad by the dresser 50, i.e. $t-t_0$ (known value).

Specifically, the retainer ring pressure RRP ($t-t_0$), the center chamber pressure CAP ($t-t_0$), the ripple chamber pressure RAP ($t-t_0$), the outer chamber pressure OAP ($t-t_0$), the edge chamber pressure EAP ($t-t_0$) and the elastic membrane height MH ($t-t_0$) in the known amount of wear of the polishing pad, i.e. $t-t_0$ (known value), can be expressed by the following relational expressions (polishing condition correction formulae):

$$RRP(t-t_0)=A(t-t_0)^2+B(t-t_0)+C$$

$$CAP(t-t_0)=D(t-t_0)^2+E(t-t_0)+F$$

$$RAP(t-t_0)=G(t-t_0)^2+H(t-t_0)+I$$

$$OAP(t-t_0)=J(t-t_0)^2+K(t-t_0)+L$$

$$EAP(t-t_0)=M(t-t_0)^2+N(t-t_0)+O$$

$$MH(t-t_0)=P(t-t_0)^2+Q(t-t_0)+R$$

The constants A to R in the above relational expressions are determined by substituting the optimal values of the polishing parameters obtained in the step 1 and determined by experiment or simulation, into the above relational expressions. The relational expressions thus obtained are stored in the storage unit 47*b* of the controller 47.

On the other hand, in the polishing apparatus, as described above, the initial position $t_0$ (measured value) of the polishing pad 101 immediately after replacement of the polishing pad is measured through measurement of the initial position of the dresser 50. The initial position $t_0$ (measured value) of the polishing pad 101 is stored in the memory unit 47*a* of the controller 47. The position t (measured value) of the polishing pad 101 after actual polishing of the substrate(s), and during dressing or after dressing of the polishing pad 101 by the dresser 50 is measured e.g. at regular intervals, and the amount of wear of the polishing pad 101, i.e. $t-t_0$ (measured value), is measured from the difference between the position t and the initial position $t_0$ (measured value) of the polishing pad 101 stored in the memory unit 47*a* (step 3).

Next, the relational expressions (polishing condition correction formulae), stored in the storage unit 47*b*, are drawn to the calculation unit 47*c*, where the actual amount of wear of the polishing pad 101, i.e. $t-t_0$ (measured value), is assigned to "($t-t_0$)" in the right-hand side of each relational expression, thereby determining the optimal values of the polishing parameters with respect to the amount of wear of the polishing pad, i.e. $t-t_0$ (measured value). Specifically, the optimal values of the retainer ring pressure RRP ($t-t_0$), the center chamber pressure CAP ($t-t_0$), the ripple chamber pressure RAP ($t-t_0$), the outer chamber pressure OAP ($t-t_0$), the edge chamber pressure EAP ($t-t_0$) and the elastic membrane height MH ($t-t_0$) are determined (step 4).

Then, the optimal values of the polishing parameters obtained in the step 4, i.e. the optimal polishing conditions, are reflected in subsequent polishing (step 5). Thus, the polishing can be performed with such feedforward control that when the thickness of the polishing pad 101 has decreased by dressing of the polishing pad 101, the polishing conditions are appropriately changed according to the amount of wear (decrease in the thickness) of the polishing pad 101.

Then, in the case where a limit amount of wear of the polishing pad is expressed as $t_{limit}$, while the amount of wear of the polishing pad, i.e. $t-t_0$ is smaller than the limit amount $t_1-[(t_0)<t_{limit}]$, the above operation from the step 3 to the step 5 is repeated. When the amount of wear of the polishing pad reaches the limit amount $t_{limit}$, the polishing pad is replaced with a new one.

In above embodiment, the polishing condition correction formula, using the amount of wear of a polishing pad as a variable, is determined from the data obtained as known data on the amount of wear of the polishing pad, and the optimal polishing parameter set values. However, it is also possible to use the number of substrates that have been polished on the same polishing pad or the accumulated dressing time for the polishing pad as the known data, instead of the amount of wear of the polishing pad. An algorithm for correction of polishing conditions (e.g. a polishing condition correction formula) may be determined from the relationship between the number of substrates that have been polished on the same polishing pad or the accumulated dressing time for the polishing pad as the known data, and the optimal polishing parameter set values.

In that case, the number of substrates that have been polished on the same polishing pad or the accumulated dressing time for the polishing pad is actually measured, and the optimal polishing parameters are determined from the measured value of the number of the polished substrates or the accumulated dressing time and the algorithm for correction of polishing conditions (e.g. a polishing condition correction formula). Then, the film on the substrate is polished by the polishing apparatus while reflecting the optimal polishing parameters. In this case also, the feedforward control which can change the polishing conditions appropriately according to the amount of wear (decrease in the thickness) of the polishing pad 101 when the thickness of the polishing pad 101 has decreased by dressing of the polishing pad 101 can be performed. According to this feedforward control process, the polishing pad measuring device such as the displacement sensor 60 can be eliminated.

A factor of the modulus of elasticity of the polishing pad may be added to the polishing time correction formula and the polishing condition correction formula. As an indicator of the elasticity of the polishing pad, the dresser may be pressed against a polishing pad at two or more levels of pressures to obtain the displacement difference in the position of the dresser, and the obtained displacement difference may be used.

A change in the elasticity of a polishing pad due to its wear is a cause of a change in the polishing profile. Variation in the modulus of elasticity among the polishing pads lowers the accuracy of correction of polishing time or correction of polishing conditions. Therefore, the polishing apparatus may be provided with a measurement instrument 600 (as shown in FIG. 3) for measuring the modulus of elasticity of the polishing pad 101, or a measurement instrument for measuring the cut rate of the dresser 50 in order to eliminate variation among production lots of the dresser 50 and the degree of wear of the dresser. By reflecting such information in the form of a multiple regression equation, in addition to information on the amount of wear of the polishing pad 101 or the thickness of the polishing pad 101, it becomes possible to enhance the accuracy of estimation of the polishing time or estimation of the optimal polishing conditions.

Further, the thickness of the polishing pad 101 may be actually measured instead of the amount of wear of the polishing pad, and the feedforward control for controlling polishing conditions such as polishing pressure on the basis of the information about measurement may be performed. A polynomial using the actual thickness of the polishing pad as a variable, or a table showing the relationship between the actual thickness of the polishing pad and the (estimated) polishing pad may also be used as an algorithm for correction of the polishing conditions.

Although certain preferred embodiments of the present invention have been shown and described in detail, it should be understood that various changes and modifications may be made therein without departing from the scope of the appended claims.

What is claimed is:

1. A polishing apparatus for polishing a film formed on a substrate by pressing the substrate against a polishing pad on a polishing table, comprising:

a polishing pad measuring device configured to measure a thickness of the polishing pad used for polishing;

a modulus of elasticity measuring device configured to measure a modulus of elasticity of the polishing pad;

a memory unit configured to store the thickness of the polishing pad, measured by the polishing pad measuring device and to store the modulus of elasticity of the polishing pad;

a storage unit configured to store an algorithm for correction of polishing time, wherein the algorithm is prepared based on the combination of:

a known thickness value, a known modulus of elasticity of the polishing pad value, a polishing time required to polish a predetermined polishing amount of the substrate by the polishing pad having the known thickness value and the known modulus of elasticity of the polishing pad value, and the predetermined polishing amount, or the known thickness value, the known modulus of elasticity of the polishing pad value, a polishing amount obtained when the substrate is polished by a predetermined polishing time by the polishing pad having the known thickness value and the known modulus of elasticity of the polishing pad value, and the predetermined polishing time; and a calculation unit configured to calculate an optimal polishing time for a polishing target value, wherein the optimal polishing time for the polishing target value is calculated based on the combination of: a current thickness of the polishing pad measured by the polishing pad measuring device, a current modulus of elasticity measured by the modulus of elasticity measuring device, and the algorithm for correction of polishing time.

2. The polishing apparatus according to claim 1, further comprising a film thickness measuring device configured to measure an initial thickness of the film on the substrate;

wherein the measured initial thickness of the film is stored in the memory unit.

3. A polishing apparatus for polishing a film formed on a substrate by pressing the substrate against a polishing pad on a polishing table, comprising:

a polishing pad measuring device configured to measure an amount of wear of the polishing pad;

a modulus of elasticity measuring device configured to measure a modulus of elasticity of the polishing pad;

a memory unit configured to store the amount of wear of the polishing pad measured by the polishing pad measuring device and to store the modulus of elasticity of the polishing pad;

a storage unit configured to store an algorithm for correction of polishing time, wherein the algorithm is prepared from:

a relationship between a known amount of wear and a known modulus of elasticity of a polishing pad, and the polishing time required to polish a predetermined polishing amount of the substrate by the polishing pad having the known amount of wear and the known modulus of elasticity of the polishing pad, and the predetermined polishing amount, or a relationship between the known amount of wear and the known modulus of elasticity of the polishing pad, and a polishing amount obtained when the substrate is polished by a predetermined polishing time by the polishing pad having the known amount of wear and the known modulus of elasticity of the polishing pad, and the predetermined polishing time; and a calculation unit configured to calculate an optimal polishing time for a polishing target value, wherein the optimal polishing time for the polishing target value is calculated from the combination of:

a current amount of wear of the polishing pad measured by the polishing pad measuring device, a current modulus of elasticity measured by the modulus of elasticity measuring device, and the algorithm for correction of polishing time.

4. The polishing apparatus as recited in claim 3 wherein the amount of wear of the polishing pad measured by the polishing pad measuring device is determined by measuring a thickness of the polishing pad.

5. The polishing apparatus as recited in claim 1, wherein the algorithm for correction of polishing time has a self-correction function comprising:

measuring the thickness of the polishing pad, the modulus of elasticity of the polishing pad, the polishing amount and the polishing time, when the substrate is polished, and correcting the algorithm based on a result of the measuring.

6. The polishing apparatus as recited in claim 3, wherein the algorithm for correction of polishing time has a self-correction function comprising:

measuring the amount of wear of the polishing pad, the modulus of elasticity of the polishing pad, the polishing amount and the polishing time, when the substrate is polished, and correcting the algorithm based on a result of the measuring.

7. The polishing apparatus as recited in claim 1, wherein the optimal polishing time comprises the time required to polish a predetermined polishing amount of the film by the polishing pad.

8. The polishing apparatus as recited in claim 3, wherein the optimal polishing time comprises the time required to polish a predetermined polishing amount of the film by the polishing pad.

* * * * *